US005794294A

United States Patent [19]

Weidmann et al.

[11] Patent Number: 5,794,294

[45] Date of Patent: Aug. 18, 1998

[54] APPARATUS FOR CLEANING PLAY BALLS

[76] Inventors: Lawrence W. Weidmann, N21 W24052 Dorchester Dr. #6A, Pewaukee, Wis. 53072; Laura J. Bucaro; Michael V. Bucaro, both of 12750 W. Bobwood St., New Berlin, Wis. 53151

[21] Appl. No.: 699,467

[22] Filed: Aug. 19, 1996

[51] Int. Cl.[6] ..... A63B 47/04

[52] U.S. Cl. ..... 15/21.2; 15/3.12; 15/21.1

[58] Field of Search ..... 15/3.12, 3.15, 15/3.1, 21.1, 21.2, 56, 58, 76

[56] References Cited

U.S. PATENT DOCUMENTS

| | | | |
|---|---|---|---|
| 600,394 | 3/1898 | Wright et al. | 15/21.2 X |
| 848,350 | 3/1907 | Corey | 15/3.15 X |
| 1,795,671 | 3/1931 | Ott et al. | 15/56 |
| 2,050,376 | 8/1936 | Pollack | 15/21.1 X |
| 2,573,173 | 10/1951 | Abbott | 15/21.1 |
| 2,931,058 | 4/1960 | Knudsen | 15/21.2 |
| 3,038,186 | 6/1962 | Davy | 15/21.2 |
| 4,112,534 | 9/1978 | Hovengen | 15/21.1 X |
| 4,181,996 | 1/1980 | Hollrock | 15/21.2 |

FOREIGN PATENT DOCUMENTS

| | | | |
|---|---|---|---|
| 1331480 | 8/1987 | U.S.S.R. | 15/3.1 |

OTHER PUBLICATIONS

HyGenie BallWashers, Intertech Corporation catalog, 4 pages, date unknown.

Ball Washing Machine, Great Northwest Company, 3 pages, date unknown.

Cleaning and Maintenance, Play Pal, 1 page, 18 Nov. 1995.

Scrub–O–Sphere 2000, S.O.S. Playland Cleaning and Maintenance, 2 pages, 18 Nov. 1995.

Cleaning Services, Boing Cleaning Services, 12 pages, 18 Nov. 1995.

Wash a Ball leaflet, Ball Pit Services, Inc., 1 page, 20 Nov. 1995.

Ball Bath Cleaning Systems, Hollrock Engineering, 5 pages, date unknown.

IAAPA's 77th Annual Convention and Trade Show Listing, 1 page, 15–18 Nov. 1995.

*Primary Examiner*—Mark Spisich

*Attorney, Agent, or Firm*—Wheeler Kromholz & Manion

[57] ABSTRACT

An apparatus for cleaning work pieces is disclosed, having a tub structure wherein cleaning liquid is introduced and a predetermined number of play balls are placed. A motor is coupled to the supporting frame. The motor generates the power to a brush mechanism which comprises an arm and a pair of brushes, with the arm's first end coupled to the first brush and the second end coupled to the second brush. The link between the motor and the brush mechanism is provided by a drive shaft structure. The drive shaft structure is substantially vertical, meeting the arm of the brush mechanism at a right angle. When the motor is functioning, the brush mechanism is activated and the brushes will clean the work pieces for a predetermined time. Once cleaning is complete, the supporting frame is rolled to one side of the tub structure and the work pieces may be removed.

15 Claims, 4 Drawing Sheets

APPARATUS FOR CLEANING PLAY BALLS

BACKGROUND OF THE INVENTION

The present invention addresses the concern for clean and sanitized play areas for children, particularly facilities using play balls. These play centers are a continuous source of germs caused by the dirt that accumulates in ball pens as well as on the balls. Therefore, the need arose for a periodical cleaning and disinfecting of play balls.

One of the various machines that supply this type of service is manufactured by Boing Creative Solutions of Bristol, United Kingdom. The machine has a cleaning capacity of 600 balls per minute in the wash unit, and 100 balls per minute in the suction unit. The balls are vacuumed into a suction-hose, then into the wash unit, washed, sterilized, and blown out into a holding area. This method of cleaning is believed to be inefficient. Although it offers a faster process, the quality of cleaning and disinfection appears to be inferior. The same result is achieved using the "HyGenie" Ball Washer manufactured by Intertech Corp. of Greensboro, N.C. It is offered in several models designed for different sizes of play facilities. The cleaning is performed at high speed, the capacity of the washer being 10,000, 20,000 or 40,000 balls per hour.

The noted prior art cleaning methods emphasize speed, i.e. the ability to process a large number of play balls in a relatively short period of time. Essentially, each ball is washed individually and quickly. It is well known that dirt is removed from materials or work pieces requiring cleaning due to the wetting action of water. The water's ability to wet an area and remove dirt is enhanced through the use of wetting agents like detergents. However, because of the fast cleaning process of the prior art, the previously mentioned systems appear not to offer enough time for the removal of dirt despite the use of detergent. The present invention remedies this situation. The slow speed of the brush mechanism and the longer dwelling of play balls inside the tub structure allow better penetration and removal of dirt and bacteria, while also allowing a large number of balls to be cleaned in a reasonable period of time.

It is an object of this invention to provide a system which will improve the quality of cleaning. It is further an object to provide such a system that is contained as one integral unit. It is further an object to provide such a system that is easy to use and produces safe results. These and other objects of the invention will become apparent in the following descriptions.

SUMMARY OF THE INVENTION

The invention consists of an apparatus for cleaning toys, typically play balls. The invention comprises a tub, a supporting frame, a motor, a drive shaft structure, and a brush mechanism.

The tub is an open top vessel wherein cleaning liquid is introduced and a predetermined number of work pieces, such as play balls, is placed. The play balls may be of different sizes; the cleaning liquid provides improved disinfection, antibacterial treatment, and deodorization.

The supporting frame is located adjacent to the tub and it may easily be positioned above the tub with help from a set of wheels coupled to several legs connected to the supporting frame. The frame includes a pivotal structure which allows the coupling of the motor, the drive shaft structure, and the brush mechanism to the frame.

The rotation generated by the motor is transmitted to the brush mechanism through a drive shaft. The drive shaft has one end coupled to the motor and the other end coupled to the brush mechanism. During the cleaning process, the brush mechanism remains fully submersed in the play balls and partially submersed in the cleaning liquid. The brush mechanism comprises an arm and a pair of brushes. The arm is substantially horizontal and is coupled to the drive shaft at a right angle. When the brushes rotate inside the tub, the play balls are scrubbed and cleaned for a predetermined period of time, preferably at least a period of one minute. The operator may adjust the time of cleaning depending on the degree of dirtiness. When the cleaning process is completed, the operator rolls the supporting frame and attached brush mechanism to one side of the tub thereby allowing the easy removal of the work pieces from the opposite side of the tub.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
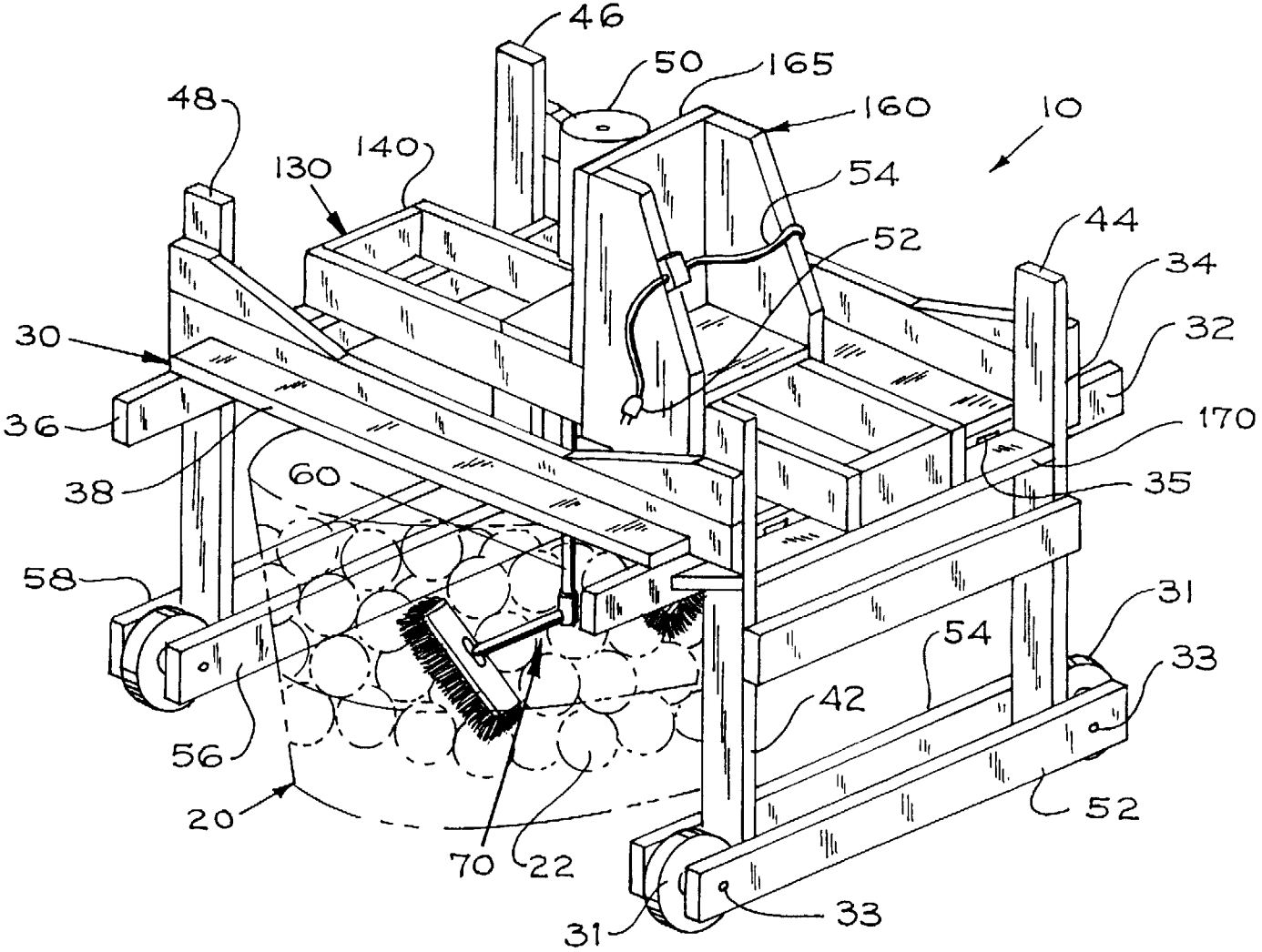
FIG. 1 is a perspective view of the invention, with the tub and work pieces shown in phantom, and with the brush mechanism inserted into the tub containing cleaning liquid and a predetermined number of work pieces, such as play balls.
Figure 2:
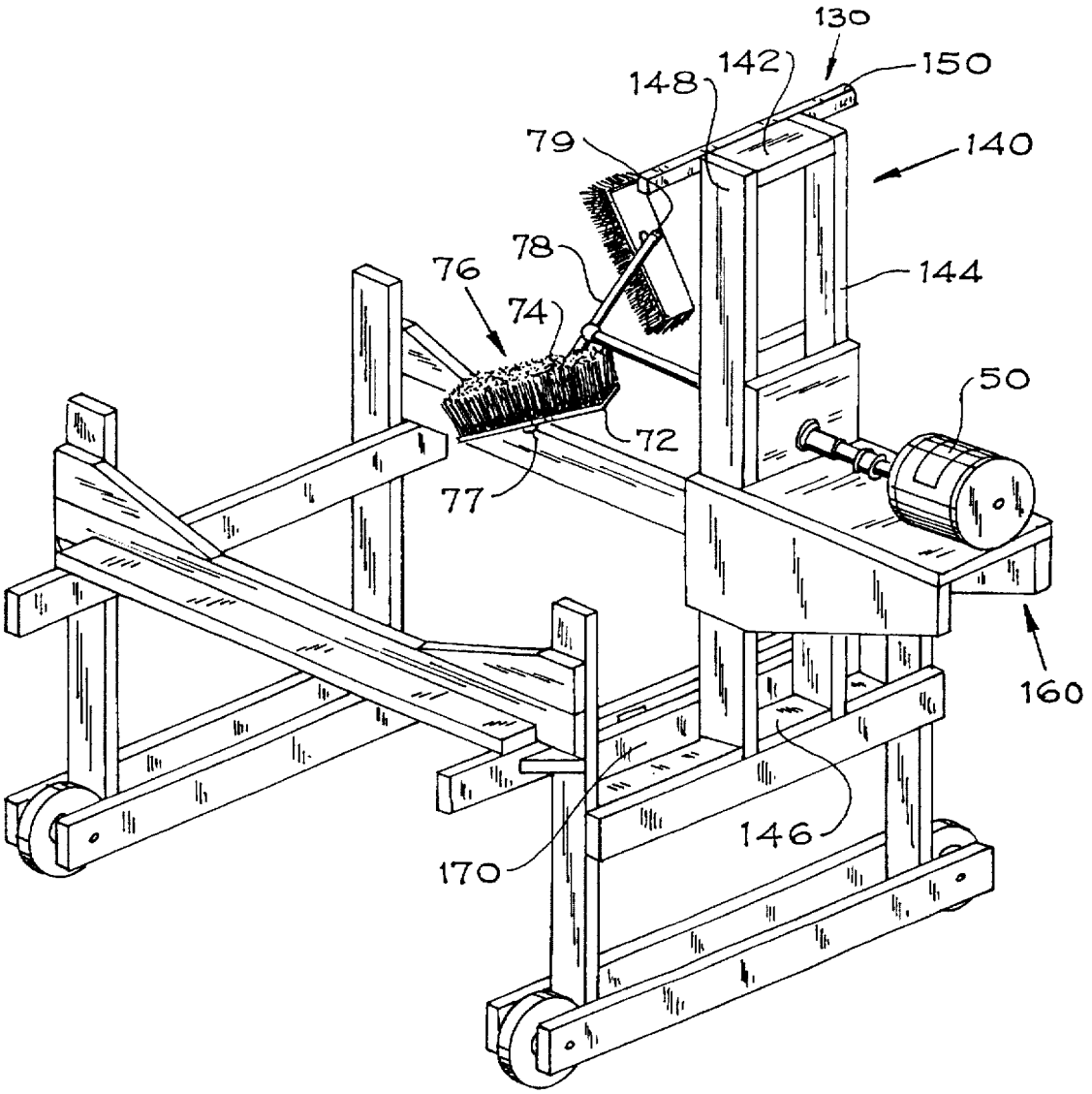
FIG. 2 is a perspective view of the invention with the brush mechanism tilted back and the pivotal structure in the upward position to facilitate tub removal and maintenance.
Figure 4:
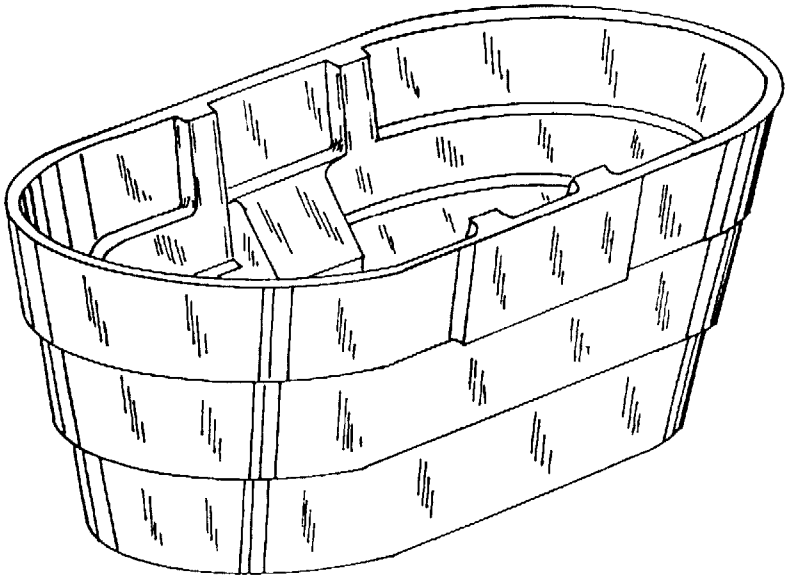
FIG. 4 is a perspective view of the tub.

One presently preferred embodiment of the apparatus for cleaning work pieces, such as play balls 22, designated generally by the reference character 10, is illustrated in FIGS. 1 and 2.

Figure 3:
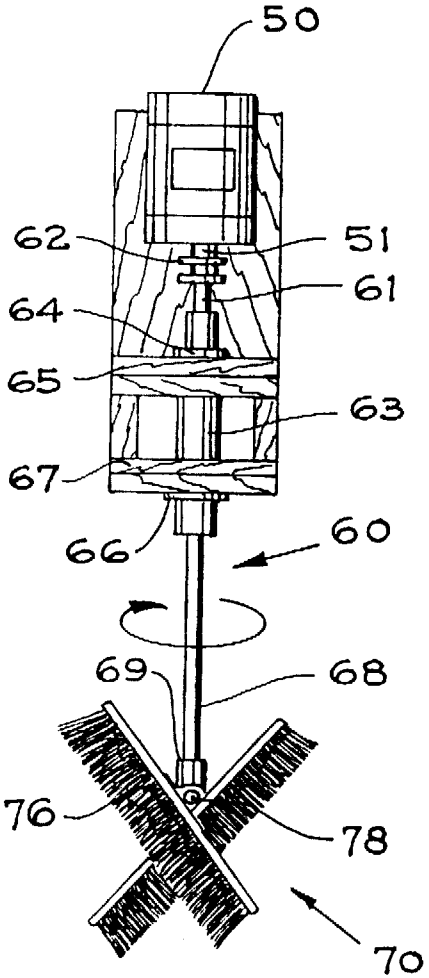
FIG. 3 is a partial top plan view showing the brush mechanism and the motor of FIG. 2.
Figure 6:
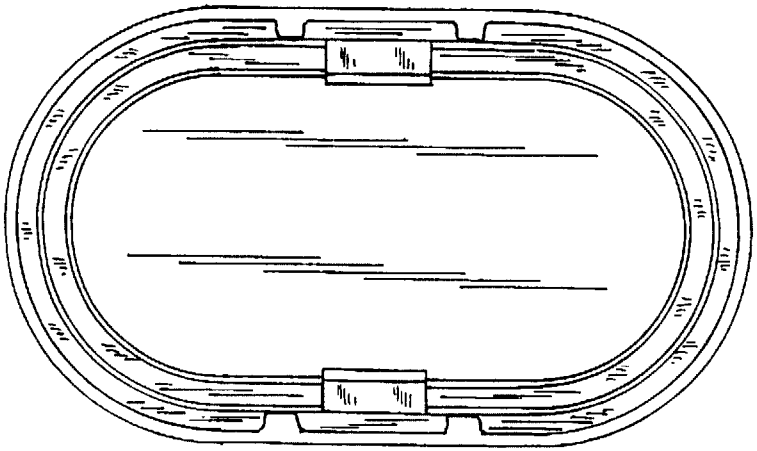
FIG. 6 is a top plan view of the tub.
Figure 5:
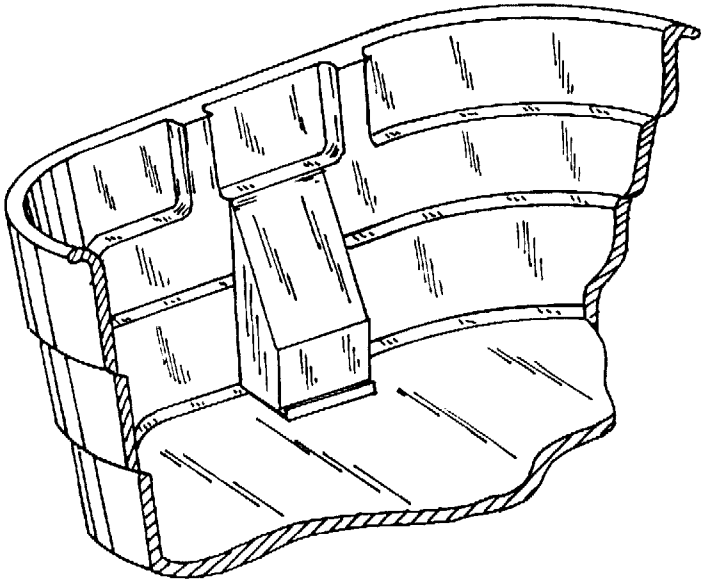
FIG. 5 is a cut-away view of the tub.

Referring to FIGS. 1 and 3, the apparatus of the present invention 10, comprises a tub 20, as illustrated by phantom lines for purposes of clearer perception, a supporting frame 30, a pivotal structure 130, a motor 50, and a brush mechanism 70, coupled to the motor 50 by means of a drive shaft structure 60.

As shown in FIG. 1, the tub 20 is an open top vessel, wherein the cleaning liquid (approximate level shown in phantom lines) is introduced and a predetermined number of work pieces, such as play balls 22 (shown in phantom lines), are placed. Also referring to FIG. 1, the tub 20 is preferably deep enough to allow the brush mechanism 70 to be fully submersed in the work pieces and partially submersed in the cleaning fluid during the cleaning process. The play balls 22 may be of different sizes, therefore showing the universal character of the present invention. The cleaning liquid may be of any effective type desired, but preferably a mixture of clean water, detergent and/or bleach providing improved disinfection, antibacterial treatment, and deodorization.

Referring to FIGS. 1 and 2, the supporting frame 30 may be easily positioned above the tub structure 20. The supporting frame 30 includes four frame members 32, 34, 36, 38. Member 32 is attached substantially perpendicular to member 34. Member 34 is attached substantially perpendicular to member 36. Member 36 is attached substantially perpendicular to member 38. Member 38 is attached substantially perpendicular to member 32. At the junction of each frame member 32, 34, 36, 38, a support leg is attached at its proximate end, substantially perpendicular to the plane formed by members 32, 34, 36, 38. In FIG. 1, the support legs are shown as 42, 44, 46, 48. At the distal ends of the support legs 42 and 44, a pair of rails 52 and 54 are coupled such that the longitudinal axis of each rail is parallel to the plane formed by frame members 32, 34, 36, 38. At the distal ends of the support legs 46 and 48, a pair of rails 56 and 58 are coupled such that the longitudinal axis of each rail is parallel to the plane formed by frame members 32, 34, 36, 38. Between each pair of rails, 52 and 54, 56 and 58, at the outermost end of each rail, a wheel 31 is rotatably supported on an axle 33 that passes through each pair of rails, 52 and 54, 56 and 58.

Referring to FIG. 2, the pivotal structure 130 comprises a rotating arm 140, a securing piece 150, a base structure 160, and an arm support 170. The rotating arm 140 is slightly longer than the supporting frame 30. As shown in FIG. 1, while the rotating arm 140 is in the downward position, with its longitudinal axis parallel to the plane formed by frame members 32, 34, 36, 38, it rests on the supporting frame member 36. The rotating arm 140 comprises four rotating members 142, 144, 146, 148. Member 142 is attached substantially perpendicular to member 144. Member 144 is attached substantially perpendicular to member 146. Member 146 is attached substantially perpendicular to member 148. Member 148 is attached substantially perpendicular to member 142. The securing piece 150 is attached adjacent to the rotating member 142. The rotating arm 140 is attached to the arm support 170. The arm support 170 is coupled to the frame member 32 by means of a pair of hinges 35.

Referring back to FIG. 1, the base structure 160 comprises a base platform 165 which houses the motor 50. The base structure 160 is permanently attached to the rotating arm's midsection 140 and substantially perpendicular to it. The motor 50 is capable of generating 60 RPM and transmits the power to a brush mechanism 70 by means of a drive shaft structure 60. However, motors of different speeds may be substituted with proper conventional gear reduction. During the cleaning process, with the rotating arm 140 in the downward position, the longitudinal axis of the motor 50 is substantially perpendicular to the plane formed by frame members 32, 34, 36, 38, and centered on the tub 20. The energy is transmitted to the motor 50 by means of an electric plug 52 and an electric cord 54, attached to the base platform 165. Referring to FIG. 3, one end 61 of the drive shaft structure 60 is coupled to the motor 50 through the motor output shaft 51 by means of a coupling 62. The drive shaft structure 60 further comprises an upper bearing 64, a lower bearing 66, a shaft 68, a bearing spacer 63, an upper bearing support 65, and a lower bearing support 67. The upper bearing 64 rests within the upper bearing support 65 and the lower bearing 66 rests within the lower bearing support 67. The other end 69 of the drive shaft structure 60 is coupled to the brush mechanism 70.

The brush mechanism 70 is capable of turning and comprises an arm 78 and a pair of brushes 76. The arm's first end 77 is coupled to the first brush 76, and the second end 79 is coupled to the second brush 76. When functioning, the arm 78 is substantially horizontal and is centrally coupled to the drive shaft structure 60. As shown in FIG. 2, the brush 76 comprises a handle 72 and bristles 74, attached to the handle. The brushes 76 are coupled at a right angle to the arm 78 and form a spatial angle between them.

The apparatus for cleaning work pieces, such as play balls, referred to as 10, works as follows. First, the cleaning liquid is introduced into the tub 20. The operator rotates the pivotal structure 130 downwardly until the brush mechanism 70 enters the tub 20 and the pivotal structure 130 rests horizontally on the supporting frame 30, with the securing piece 150 adjacent to the frame member 36. At this point the brush mechanism 70 should preferably be partially submersed in the cleaning liquid. Then, a predetermined number of work pieces 22 are placed into the tub 20.

Second, the operator energizes the motor 50 which activates the brush mechanism 70. The drive shaft structure 60 will rotate the arms 78 of the brush mechanism 70 and the brushes 76 will describe a circular path, scrubbing and cleaning the play balls 22. The relatively slow speed of the brush mechanism 70 and the longer dwelling of the play balls 22 inside the tub 20 allow for better cleaning, wetting, and removal of dirt and bacteria. The cleaning should last a predetermined period of time, preferably at least one minute, but the operator may adjust the time of cleaning depending on the degree of dirtiness.

When the cleaning process is completed, the operator de-energizes the motor 50. Then, he or she rolls aside the supporting frame 30, leaving the brush mechanism inside the tub 20. The operator may then remove the play balls 22 from the tub 20.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An apparatus to be used in a process of cleaning work pieces, said apparatus comprising:

a tub arranged to receive a cleaning liquid and a plurality of said work pieces;

a supporting frame, said supporting frame located adjacent to said tub and at least a portion of said frame being positioned above said tub;

a supporting structure pivotally coupled to said supporting frame;

a motor, said motor supported by said supporting structure;

a drive shaft structure, said drive shaft structure having a first end and a second end;

said first end of said drive shaft structure being coupled to said motor; and a brush mechanism, said brush mechanism being coupled to said second end of said drive shaft structure, and being adapted to agitate said liquid and to scrub said work pieces.

2. The apparatus of claim 1, wherein said brush mechanism comprises:

an arm, having a first end and a second end, and being coupled to said second end of said drive shaft structure; and a first brush and a second brush, said first brush coupled to said first end of said arm and said second brush coupled to said second end of said arm.

3. The apparatus of claim 1, wherein said supporting structure further comprises:

a rotating arm, having a first end and a second end;

an arm support;

a securing piece;

said first end of said rotating arm being coupled to said arm support;

said second end of said rotating arm being coupled to said securing piece;

a base structure, said base structure being coupled to said rotating arm's midsection.

4. The apparatus of claim 3, wherein said arm support of said supporting structure is coupled to said supporting frame by means of a pair of hinges.

5. The apparatus of claim 3, wherein said base structure of said supporting structure comprises a base platform housing said motor.

6. The apparatus of claim 3, wherein said tub is an open top vessel, sized to hold a predetermined number of work pieces.

7. The apparatus of claim 1, wherein said supporting frame comprises:

a plurality of frame members, said frame members being coupled to form a plane;

a plurality of support legs, said support legs being coupled to said frame members, substantially perpendicular to said plane formed by said frame members.

8. The apparatus of claim 2, wherein said drive shaft structure has an axis that is substantially vertical when in an operative position, said arm of said brush mechanism being secured intermediate its ends to said drive shaft structure and lying in a plane substantially perpendicular to said vertical axis of said drive shaft structure; said brush mechanism being adapted to agitate said workpieces.

9. An apparatus to be used in a process of cleaning work pieces, said apparatus comprising:

a vessel, said vessel having an open top and being arranged to receive a cleaning liquid and a plurality of said work pieces;

a frame, at least a portion of said frame being positioned above said vessel;

a pivotal structure, said pivotal structure being coupled to said frame and having a base structure attached thereto;

a motor, said motor supported by said base structure of said pivotal structure;

a brush device, said brush device being coupled to said motor by means of a drive shaft structure and being adapted to agitate said liquid and to scrub said work pieces.

10. The apparatus of claim 9, wherein said brush device comprises:

an arm, said arm coupled to said drive shaft structure;

a first brush and a second brush coupled to said arm.

11. The apparatus of claim 9, wherein said pivotal structure further comprises:

a revolving member, having a first end and a second end;

said second end of said revolving member coupled to said frame; and a stabilizing piece coupled to said first end of said revolving member.

12. The apparatus of claim 11, wherein said revolving member is coupled to said frame by means of a pair of hinges.

13. The apparatus of claim 9, wherein said base structure of said pivotal structure comprises a base platform supporting said motor.

14. The apparatus of claim 9, wherein said frame comprises:

a plurality of frame members, said frame members forming a plane;

a plurality of support members, said support members coupled to said frame members and substantially perpendicular to said plane formed by said frame members.

15. The apparatus of claim 10, wherein said drive shaft structure has a substantially vertical axis when in an operative position, said arm of said brush device being secured intermediate its ends to said drive shaft structure and lying in a plane substantially perpendicular to said vertical axis of said drive shaft structure.

* * * * *